US007867295B2

(12) United States Patent
Schield et al.

(10) Patent No.: US 7,867,295 B2
(45) Date of Patent: Jan. 11, 2011

(54) BRANCHED CARBOXYLIC ACIDS AS FUEL LUBRICITY ADDITIVES

(75) Inventors: John A. Schield, Missouri City, TX (US); Paul J. Biggerstaff, Stafford, TX (US)

(73) Assignee: Baker Hughes Incorporated, Houston, TX (US)

( * ) Notice: Subject to any disclaimer, the term of this patent is extended or adjusted under 35 U.S.C. 154(b) by 500 days.

(21) Appl. No.: 11/847,141

(22) Filed: Aug. 29, 2007

(65) Prior Publication Data

US 2009/0056203 A1 Mar. 5, 2009

(51) Int. Cl.
*C10L 1/18* (2006.01)

(52) U.S. Cl. ..... 44/385

(58) Field of Classification Search ..... 44/385
See application file for complete search history.

(56) References Cited

U.S. PATENT DOCUMENTS 2,985,522 A * 5/1961 Binning et al. ..... 44/385
3,522,022 A * 7/1970 May et al. ..... 44/406
4,474,579 A 10/1984 Wilderson et al.
4,857,073 A 8/1989 Vataru et al.
6,129,772 A 10/2000 Weers et al.
6,793,695 B2 * 9/2004 Wilkes et al. ..... 44/385
7,402,185 B2 * 7/2008 Aradi et al. ..... 44/385
2004/0010967 A1 1/2004 Aradi et al.
2006/0288638 A1 12/2006 Schwab
2007/0094920 A1 5/2007 Ahlers et al.

* cited by examiner

*Primary Examiner*—Cephia D Toomer
(74) *Attorney, Agent, or Firm*—Mossman Kumar & Tyler PC

(57) ABSTRACT

Certain branched carboxylic acids may serve as improved lubricity additive compositions in distillate fuels, and in particular for cold weather applications. Suitable branched carboxylic acids may include, but are not necessarily limited to, isostearic acid, neodecanoic acid, isononanoic acid, neononanoic acid, neoundecanoic acid, isovaleric acid, pivalic acid, and the like and mixtures thereof. The branched carboxylic acids may be used alone or together with straight chain carboxylic acids, and optionally with an aromatic solvent.

18 Claims, 2 Drawing Sheets

BRANCHED CARBOXYLIC ACIDS AS FUEL LUBRICITY ADDITIVES

TECHNICAL FIELD

The present invention relates to lubricity additives for hydrocarbon fuels, and more particularly relates, in one embodiment to the use of lubricity additives for distillate fuels in cold weather applications.

TECHNICAL BACKGROUND

It is well known that in many engines the fuel is the lubricant for the fuel system components, such as fuel pumps and injectors. Many studies of fuels with poor lubricity have been conducted in an effort to understand fuel compositions that have poor lubricity and to correlate lab test methods with actual field use. The problem is general to diesel fuels, kerosene and gasolines, however, most of the studies have concentrated on the first two hydrocarbons.

Previous work has shown that saturated, monomeric and dimeric, fatty acids of from 12 to 54 carbon atoms used individually give excellent performance as fuel lubricity aids in diesel fuels. Fatty acids are by definition unbranched. A number of other kinds of lubricity additives are also known. Since the advent of low sulfur diesel fuels in the early 1990s, relatively large amounts of these lubricity additives have been used to provide a fuel that does not cause excessive wear of engine parts.

Unfortunately, many commercially available fatty acids and fatty acid blends tend to freeze or form crystals at temperatures common during winter weather. The freezing or formation of crystals makes handling of the additives, and particularly injection into fuel, difficult. Blending the fatty acid with a solvent can reduce the crystal formation temperature, or cloud point. However, addition of a solvent may increase cost and preparation complexity.

Some of the fatty acids, fatty acid ammonium salts and fatty acid amides presently used may have the disadvantage of solidifying on storage at low temperatures Often even at room temperature, but usually at temperatures of 0° C., crystalline fractions may separate and cause handling problems. Diluting the additives with organic solvents only partly solves the problem, since fractions may still crystallize out from solutions or the solution may gel and solidify. Thus, for use as lubricity additives, the fatty acids, fatty acid ammonium salts and fatty acid amides either have to be greatly diluted or kept in heated storage vessels and added via heated pipework.

Thus, it would be desirable if a way could be discovered to enhance the lubricity of distillate fuels, but the fuels remain homogeneous, clear and flowable at low temperatures. Further, the cold flow properties of middle distillate fuels with the additives should not be significantly adversely affected.

SUMMARY

There is provided, in one form, a method for improving the lubricity of distillate fuel that involves adding to a hydrocarbon-based distillate fuel an effective amount of a composition for improving the lubricity of the hydrocarbon, where the composition includes at least one branched carboxylic acid. In one non-limiting embodiment the branched carboxylic acid may have from 3 to 60 carbon atoms, and in another non-restrictive version the branched carboxylic acid may be a neoalkanoic acid.

There is additionally provided a distillate fuel having improved lubricity that includes a hydrocarbon-based distillate fuel, and an effective amount of a composition for improving the lubricity of the hydrocarbon, where the composition contains at least one branched carboxylic acid.

DETAILED DESCRIPTION OF THE EMBODIMENTS

Figure 1:
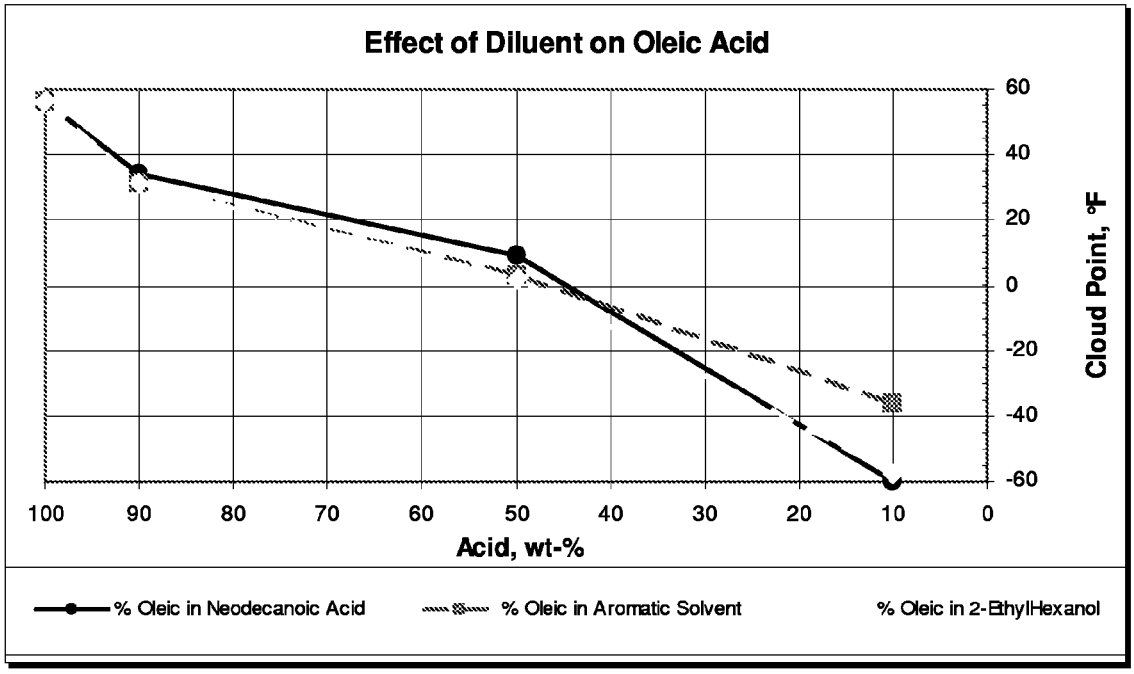
FIG. 1 is a graph of cloud point as a function of % oleic acid in various diluents.

New compositions have been discovered which contain branched carboxylic acid that are useful as fuel lubricity aids particularly at low temperature applications, such as during cold weather.

The compositions and methods described herein relate to lubricity additive compositions for distillate fuels, as contrasted with products from resid. In the context herein, distillate fuels include, but are not necessarily limited to diesel fuel, kerosene, gasoline and the like. It will be appreciated that distillate fuels include blends of conventional hydrocarbons meant by these terms with oxygenates, e.g. alcohols, such as methanol, ethanol, and other additives or blending components presently used in these distillate fuels, or that may be used in the future. In one non-limiting embodiment, the methods and compositions herein relate to low sulfur fuels, which are defined as having a sulfur content of 0.2% by weight or less, and in another non-limiting embodiment as having a sulfur content of about 0.0015 wt. % or less—such as the so-called "ultra low sulfur" fuels. Particularly preferred hydrocarbon fuels herein are diesel and kerosene, and in one non-restrictive version, ultra low sulfur diesel (ULSD) fuels.

Generally, in one embodiment of the methods and compositions herein, the composition for improving the lubricity of distillate fuels includes at least one branched carboxylic acid. The branched carboxylic acids may have from 3 to 60 carbon atoms, and in an alternative embodiment herein may have from 6, independently up to 14 carbon atoms Specific examples of suitable branched carboxylic acids may include, but are not necessarily limited to, isostearic acid, neodecanoic acid, isononanoic acid, neononanoic acid, neoundecanoic acid, isovaleric acid, pivalic acid, and the like and mixtures thereof. In another non-limiting version, the at least one branched carboxylic acid is a neoalkanoic acid, such as the neoalkanoic acids mentioned above, possibly having from 3 to 60 carbon atoms, in another non-restrictive embodiment having from about 6 independently up to about 14 carbon atoms. The branched carboxylic acids herein may be saturated or unsaturated. It will be appreciated that in many cases the branched carboxylic acids may not be purely one compound, but may be blends of isomers.

The branched carboxylic acids useful herein may be used alone or together with straight chain carboxylic acids. Such straight chain acids may be saturated, unsaturated, mixed saturated and unsaturated mono-, di- and tri-carboxylic acids having from 12 to 72 carbon atoms, alternatively from 12, independently up to 20. Specific examples of suitable straight chain carboxylic acids include, but are not necessarily limited to, oleic acid, linoleic acid, stearic acid, tall oil fatty acid (TOFA) derived monomer acid, linolenic acid, palmitic acid, coco fatty acid and mixtures thereof. It should be understood that the definition of these suitable carboxylic acids include so-called synthetic acids, which may include, but are not necessarily limited to acids such as ricinoleic acid, hydrogenated monomer and oligomer fatty acids, and substituted fatty acids and mixtures thereof.

In one non-limiting embodiment of the methods and compositions, the proportion of the branched carboxylic acid lubricity additive in the total distillate fuel should at least be an amount to improve the lubricity of the distillate fuel as compared to an identical distillate fuel absent the additive. Alternatively, the amount of additive may range from about 1 to about 500 ppm, and in an alternate embodiment, the lower threshold may be about 75 ppm and the upper threshold may independently be about 200 ppm. When a straight chain carboxylic acid is employed together with the branched carboxylic acid, the proportion of straight chain carboxylic acid in the total distillate fuel ranges from about 50 to about 200 ppm, and in an alternate embodiment, the lower threshold may be about 10 ppm and the upper threshold may independently be about 450 ppm.

It will be appreciated that the methods and compositions herein also encompasses distillate fuels containing the compositions herein as well as methods of improving the lubricity properties of distillate fuels using the compositions herein. In one non-limiting embodiment, the improved lubricity is defined as an improvement in WSD of at least about 5% as compared with an otherwise identical fuel absent the additive, and in an alternative non-restrictive embodiment may be at least a 10% improvement. A typical fuel without a lubricity additive may have a wear scar of about 600 microns and this would be reduced to about 500 microns with the additive.

Further, the lubricity improving compositions herein may have improved cold temperature handling as compared with otherwise identical fuels absent the compositions. For instance, in one non-limiting embodiment, the cloud point may be lowered by at least about 5° F. (about 3° C.), and alternatively by at least about 10° F. (about 6° C.).

In some cases, a solvent may be advantageously used in the compositions herein, where the solvent may be an aromatic solvent and/or a pure paraffinic solvent and/or even an alcoholic solvent. Aromatic solvents are particularly suitable in one non-limiting embodiment. The proportion of solvent in the total fuel lubricity aid composition may range from about 0 to 90 weight %. The use of a solvent is optional. Specific examples of suitable paraffinic or non-aromatic solvents include, but are not limited to paraffins and cycloparaffins, kerosene, diesel, gasoline, alcohols (e.g. 2-ethyl hexanol, 2-propanol, 2-butanol, butyl carbitol and the like), and the like and blends thereof. Suitable examples of aromatic solvents may include, but are not necessarily limited to, aromatic naphtha, xylene, toluene, isopropyl benzene, mesitylene, ethylbenzene, and the like and blends thereof. Blends of non-aromatic and aromatic solvents may be suitably used.

Other, optional components of the compositions for the distillate fuels herein, or added independently to the distillate fuels, in non-limiting embodiments may include, but are not necessarily limited to, detergents, pour point depressants, cetane improvers, dehazers, cold operability additives, conductivity additives, corrosion inhibitors, biocides, dyes, and mixtures thereof. In another non-limiting embodiment of the methods and compositions herein, water is explicitly absent from the inventive composition.

The methods and compositions herein will be illustrated further with respect to the following non-limiting Examples that are included only to further illuminate the invention and not to restrict it. As will be demonstrated, the hydrocarbon-based distillate fuels using the compositions herein have improved lubricity as compared with an identical hydrocarbon-based distillate fuel absent the branched carboxylic acid.

Test Methods

Industry standard test methodologies were used to generate the cloud point and lubricity data reported below. The thermal cycling data was based on standard no-harms effect methodology.

ASTM D5771: Cloud Point of Petroleum Products (Optical Detection Step Cooling Method)

ASTM D6079: High Frequency Reciprocating Rig (HFRR) Lubricity@60° C.

Summary of Test Results

To demonstrate the effectiveness of branched carboxylic acids on improving the lubricity performance of mid-distillate fuels, five ultra low sulfur diesel (ULSD) fuels were screened. Although research focused specifically on neodecanoic acid as the branched carboxylic acid, it is expected that other branched carboxylic acids will also have utility.

The results showed that neodecanoic acid was effective in improving the lubricity performance of the ULSD fuels, as measured by their wear scar diameter (WSD), to the current ASTM specification of 520 microns or better for the U.S. as seen in Table I. Testing was done by High Frequency Reciprocating Rig (HFRR) in accordance with ASTM D6079.

TABLE I

LUBRICITY RESULTS BY HFRR

| Ex. | Sample Fuel | Additive | Dosage, ppm | WSD, microns |
|---|---|---|---|---|
| 1 | ULSD A | Blank | 0 | 604 |
| 2 | ULSD A | Neodecanoic Acid | 50 | 540 |
| 3 | ULSD A | Neodecanoic Acid | 75 | 497 |
| 4 | ULSD B | Blank | 0 | 702 |
| 5 | ULSD B | Neodecanoic Acid | 50 | 503 |
| 6 | ULSD B | Neodecanoic Acid | 75 | 485 |
| 7 | ULSD C | Blank | 0 | 597 |
| 8 | ULSD C | Neodecanoic Acid | 50 | 567 |
| 9 | ULSD C | Neodecanoic Acid | 75 | 488 |
| 10 | ULSD D | Blank | 0 | 587 |
| 11 | ULSD D | NeodecanoicAcid | 50 | 551 |
| 12 | ULSD D | NeodecanoicAcid | 75 | 474 |
| 13 | ULSD E | Blank | 0 | 658 |
| 14 | ULSD E | Neodecanoic Acid | 50 | 566 |
| 15 | ULSD E | Neodecanoic Acid | 75 | 536 |
| 16 | ULSD E | Neodecanoic Acid | 100 | 494 |

Although it may be seen that the neodecanoic acid was very effective in improving the lubricity performance of the ULSD fuels, testing indicated that the efficacy of this product tended to level off around 475 microns. While that is acceptable for domestic applications, some countries require a greater level of lubricity performance and have a WSD specification of 460 microns. Some refiners even go a step further and target 380 microns to offset variability in the D6079 test method.

The leveling off of performance is likely attributable to the relatively short chain length, 10 carbons in this case. It is well known within the industry that longer straight chained, carboxylic fatty acids, e.g. C18, also deliver lubricity performance. These longer, straight chained carboxylic acids are capable of improving lubricity performance to WSD levels of 380 microns or better. Thus, it would be expected that longer chain length branched carboxylic acids within the definitions herein would also have improved lubricity performance.

As previously discussed, longer straight chain fatty acids typically have cold weather stability problems. Due to their saturates level, most of the tall oil fatty acid (TOFA) derived and vegetable oil derived fatty acids have relatively high titers and high cloud points. These saturates also tend to precipitate out of solution when exposed to cold temperatures for any extended period of time.

Traditional solvents such as aromatic hydrocarbons and alcohols may improve the cloud point of the fatty acids and they can improve low temperature solubility with varying degrees of effectiveness; however, none of these solvents are effective in improving the lubricity performance of mid-distillate fuels. However, it has been surprisingly discovered that branched carboxylic acids, such as neodecanoic acid, on the other hand does improve lubricity performance and it is also effective in lowering the cloud point of fatty acids and improving low temperature solubility.

To demonstrate the effectiveness of neodecanoic acid in improving the cold weather handling properties of long chained carboxylic acids, a series of tests were performed on oleic acid, linoleic acid and a TOFA derived monomer acid. The performance of neodecanoic acid as a diluent was compared to that of aromatic hydrocarbon and 2-ethyl hexanol.

The fatty acids were diluted at varying ratios and evaluated for cloud point via the ASTM D5771 test procedure and solubility after being cycled between room temperature and −20° F. (29° C.) for five days (Tables II-IV).

TABLE II

DILUENT EFFECT ON CLOUD POINT
(RATIO OF DILUENT TO OLEIC ACID, WT %)

| Ex. | Diluent | 0:100 | 10:90 | 50:50 | 90:10 |
|---|---|---|---|---|---|
| 17 | Neodecanoic Acid | 56° F. (13° C.) | +34° F. (1.1° C.) | 9° F. (−13° C.) | <−60° F. (<−51° C.) |
| 18 | Aromatic Solvent | 56° F. (13° C.) | +31° F. (−0.6° C.) | 3° F. (−16° C.) | −36° F. (−38° C.) |
| 19 | 2-Ethyl Hexanol | 56° F. (13° C.) | +31° F. (−0.6° C.) | 2° F. (−17° C.) | −58° F. (−50° C.) |

The results from Table II are plotted in FIG. 1.

TABLE III

DILUENT EFFECT ON CLOUD POINT
(RATIO OF DILUENT TO LINOLEIC ACID, WT %)

| Ex. | Diluent | 0:100 | 10:90 | 50:50 | 90:10 |
|---|---|---|---|---|---|
| 20 | Neodecanoic Acid | −16° F. (−27° C.) | −21 (−29° C.) | −57 (−49° C.) | <−60 (<−51° C.) |
| 21 | Aromatic Solvent | −16° F. (−27° C.) | −25 (−32° C.) | −40 (−40° C.) | <−60 (<−51° C.) |
| 22 | 2-Ethyl Hexanol | −16° F. (−27° C.) | −27 (−33° C.) | −52 (−47° C.) | <−60 (<−51° C.) |

Figure 2:
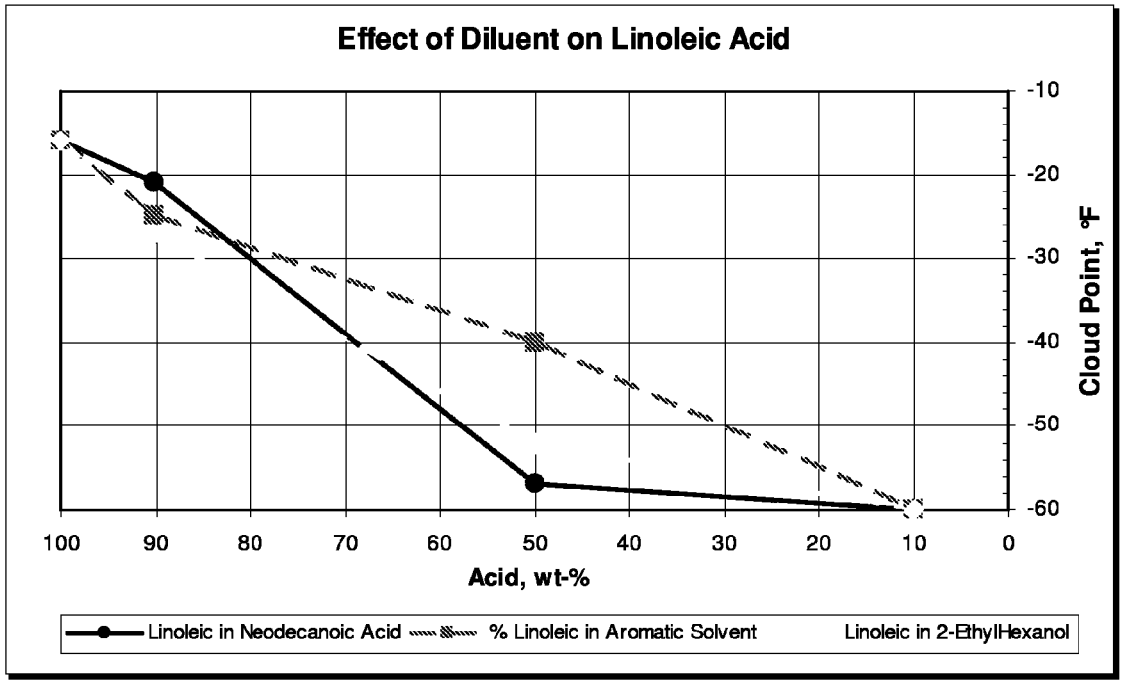
FIG. 2 is a graph of cloud point as a function of % linoleic acid in various diluents.

The results from Table III are plotted in FIG. 2.

TABLE IV

DILUENT EFFECT ON CLOUD POINT
(RATIO OF DILUENT TO MONOMER ACID, WT %)

| Ex. | Diluent | 0:100 | 10:90 | 50:50 | 90:10 |
|---|---|---|---|---|---|
| 23 | Neodecanoic Acid | 10° F. (−12° C.) | 5 (−15° C.) | −28 (−33° C.) | <−60 (<−51° C.) |
| 24 | Aromatic Solvent | 10° F. (−12° C.) | 6 (−14° C.) | −18 (−28° C.) | <−60 (<−51° C.) |
| 25 | 2-Ethyl Hexanol | 10° F. (−12° C.) | 0 (−18° C.) | −24 (−31° C.) | <−60 (<−51° C.) |

Figure 3:
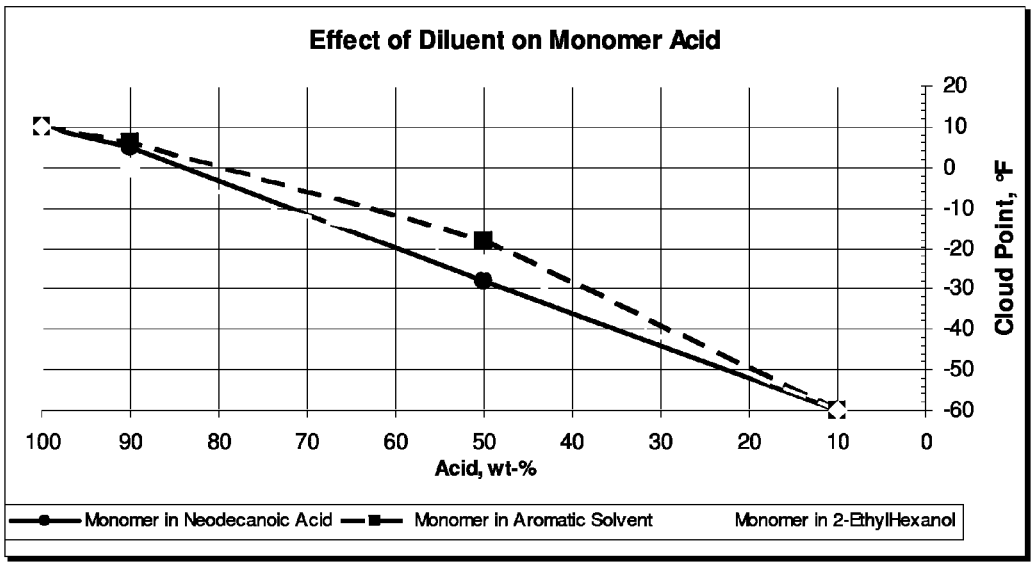
FIG. 3 is a graph of cloud point as a function of % tall oil fatty acid (TOFA) derived monomer in various diluents.

The results from Table IV are plotted in FIG. 3.

TABLE V

SOLUBILITY OF FATTY ACIDS IN VARIOUS DILUENTS CYCLED @ −20° F. (29° C.), (RATIO OF DILUENT TO FATTY ACID, WT %)

| | | Oleic Acid | | Linoleic Acid | | Monomer Acid | |
|---|---|---|---|---|---|---|---|
| Ex. | Diluent | 90:10 | 80:20 | 90:10 | 80:20 | 90:10 | 80:20 |
| 27 | Aromatic Solvent | FL. WP | FL. WP | FL. CL | FL. WP | FL. WP | FL. WP |
| 28 | 2-Ethyl Hexanol | FL. WP | FL. WP | FL. CL | FL. CL | FL. CL | FL. WP |
| 29 | Neodecanoic Acid | VS. CL | VS. CL | VS. CL | VS. CL | VS. CL | VS. CL |

LEGEND FOR TABLE V
FL = Fluid
VS = Viscous
CL = Clear, Free of Precipitates
WP = White Precipitate The above results show that neodecanoic acid is comparable to, and in some cases superior to, aromatic hydrocarbon and 2-ethyl hexanol in lowering the cloud point of the fatty acids, as well as, improving the solubility of the acids under cold temperature conditions.

Figure 4:
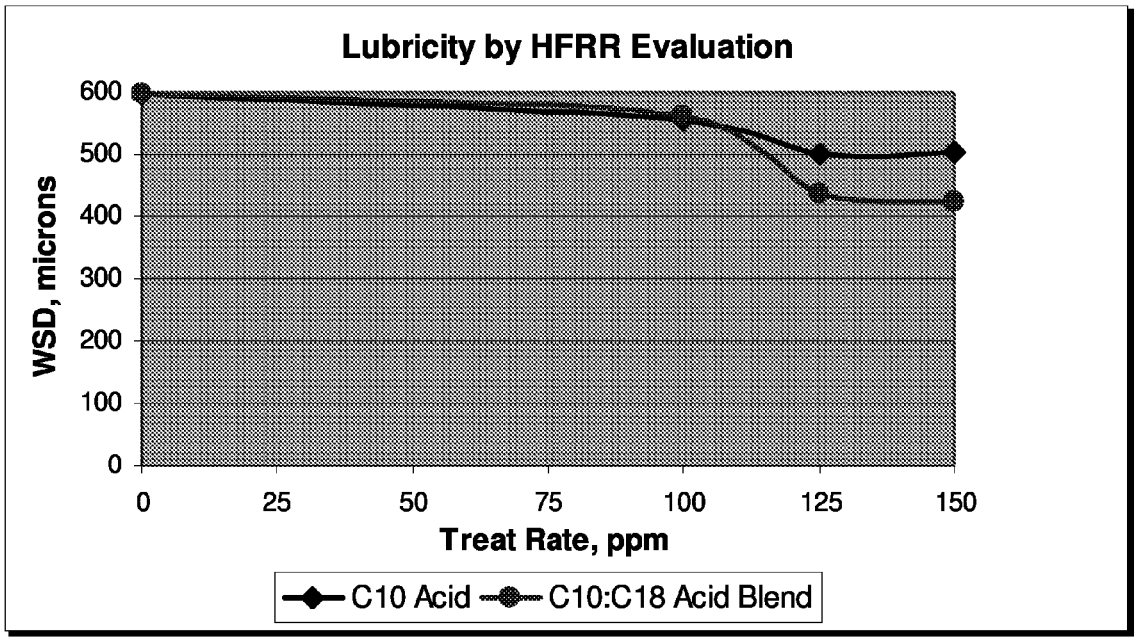
FIG. 4 is a graph of lubricity measured by wear scar diameter (WSD) using High Frequency Reciprocating Rig (HFRR) specifications for various treat rates of neodecanoic acid and a blend of neodecanoic acid with a C18 straight chain fatty acid.

The enhanced solubility of neodecanoic acid enables it to be blended with longer, straight-chained fatty acids to deliver a more effective lubricity improver at an equivalent activity, making it suitable as for an overall lubricity-enhancing composition. FIG. 4 is a graph of lubricity measured by wear scar diameter (WSD) measured by HFRR specifications for various treat rates of neodecanoic acid and a blend of neodecanoic acid with a C18 long, straight chain fatty acid.

In the foregoing specification, the methods and compositions herein have been described with reference to specific embodiments thereof, and have been demonstrated as effective for improving the lubricity of fuels. However, it will be evident that various modifications and changes can be made thereto without departing from the broader spirit or scope of the invention as set forth in the appended claims. Accordingly, the specification is to be regarded in an illustrative rather than a restrictive sense. For example, specific combinations of branched carboxylic acids with straight chain acids, but not specifically identified or tried in a particular composition to improve the lubricity of fuels herein, are anticipated to be within the scope of this invention. It is anticipated that the compositions of this invention may also impart to the engines in which they are used as fuel lubricity aids, greater horsepower, lower emissions and/or better fuel economy as a result of less friction, whether they are used in diesel or gasoline engines.

The word "comprising" as used throughout the claims herein is to be interpreted to mean "including but not limited to".

What is claimed is:

1. A method for improving the lubricity of a hydrocarbon-based distillate fuel comprising adding to the hydrocarbon-based distillate fuel a composition comprising from about 75 to about 500 ppm, based on the hydrocarbon-based distillate fuel, of at least one neoalkanoic acid having from 3 to 60 carbon atoms, where the hydrocarbon-based distillate fuel has improved lubricity as compared with an identical hydrocarbon-based distillate fuel absent the neoalkanoic acid.

2. The method of claim 1 where the neoalkanoic acid has from 6 to 14 carbon atoms.

3. The method of claim 1 where the composition further comprises a straight chain carboxylic acid.

4. The method of claim 3 where the straight chain carboxylic acid has from 12 to 20 carbon atoms.

5. The method of claim 1 where the composition further comprises an aromatic solvent.

6. A method for improving the lubricity of a hydrocarbon-based distillate fuel comprising adding to the hydrocarbon-based distillate fuel a composition, where the composition comprises at least one neoalkanoic acid having from 3 to 60 carbon atoms and an aromatic solvent, and the at least one neoalkanoic acid is present in the hydrocarbon-based distillate fuel in an amount ranging from about 75 to about 500 ppm based on the total distillate fuel, where the hydrocarbon-based distillate fuel has improved lubricity as compared with an identical hydrocarbon-based distillate fuel absent the neoalkanoic acid.

7. The method of claim 6 where the neoalkanoic acid has from 6 to 14 carbon atoms.

8. The method of claim 6 where the composition further comprises a straight chain carboxylic acid.

9. The method of claim 8 where the straight chain carboxylic acid has from 12 to 20 carbon atoms.

10. A distillate fuel having improved lubricity comprising a hydrocarbon-based distillate fuel and a composition comprising from about 75 to about 500 ppm, based on the hydrocarbon-based distillate fuel, of at least one neoalkanoic acid having from 3 to 60 carbon atoms, where the hydrocarbon-based distillate fuel has improved lubricity as compared with an identical hydrocarbon-based distillate fuel absent the neoalkanoic acid.

11. The distillate fuel of claim 10 where the neoalkanoic acid has from 6 to 14 carbon atoms.

12. The distillate fuel of claim 10 where the composition further comprises a straight chain carboxylic acid.

13. The distillate fuel of claim 12 where the straight chain carboxylic acid has from 12 to 20 carbon atoms.

14. The distillate fuel of claim 10 where the composition further comprises an aromatic solvent.

15. A distillate fuel having improved lubricity comprising:
a hydrocarbon-based distillate fuel; and
a composition, where the composition comprises:
an aromatic solvent and
at least one neoalkanoic acid having from 3 to 60 carbon atoms in an amount ranging from about 75 to about 500 ppm based on the total distillate fuel, where the hydrocarbon-based distillate fuel has improved lubricity as compared with an identical hydrocarbon-based distillate fuel absent the neoalkanoic acid.

16. The distillate fuel of claim 15 where the neoalkanoic acid has from 6 to 14 carbon atoms.

17. The distillate fuel of claim 15 where the composition further comprises a straight chain carboxylic acid.

18. The distillate fuel of claim 17 where the straight chain carboxylic acid has from 12 to 20 carbon atoms.

* * * * *